United States Patent [19]

Wachi

[11] Patent Number: 4,584,921

[45] Date of Patent: Apr. 29, 1986

[54] TONE WAVESHAPE GENERATION DEVICE

[75] Inventor: Masatada Wachi, Hamamatsu, Japan

[73] Assignee: Nippon Gakki Seizo Kabushiki Kaisha, Hamamatsu, Japan

[21] Appl. No.: 766,087

[22] Filed: Aug. 16, 1985

Related U.S. Application Data

[63] Continuation of Ser. No. 589,137, Mar. 13, 1984, abandoned.

[30] Foreign Application Priority Data

Mar. 16, 1983 [JP] Japan ..... 58-42409

[51] Int. Cl.[4] ..... G10H 1/00

[52] U.S. Cl. ..... 84/1.01; 84/1.19; 84/1.24

[58] Field of Search ..... 84/1.01, 1.03, 1.19, 84/1.24, 1.28

[56] References Cited

U.S. PATENT DOCUMENTS

| | | | |
|---|---|---|---|
| 4,305,319 | 12/1981 | Linn | 84/1.01 |
| 4,338,674 | 7/1982 | Hamada | 84/1.01 |
| 4,348,929 | 9/1982 | Gallitzendorfer | 84/1.01 |
| 4,383,462 | 5/1983 | Nagai | 84/1.26 |
| 4,442,745 | 4/1984 | Gross et al. | 84/1.01 |
| 4,463,650 | 8/1984 | Rupert | 84/1.24 |

*Primary Examiner*—Forester W. Isen

*Attorney, Agent, or Firm*—Spensley Horn Jubas & Lubitz

[57] ABSTRACT

A waveshape memory is divided into memory zones having memory capacities which differ depending upon respective tone pitches or tone ranges. In each memory zone, waveshapes of plural periods having characteristics of the corresponding tone pitch or tone range are stored. The memory zone in the waveshape memory is designated in accordance with the tone pitch or tone range of the tone to be generated. A tone signal is produced by reading out waveshapes of plural periods from the designated memory zone.

16 Claims, 8 Drawing Figures

TONE WAVESHAPE GENERATION DEVICE

CONTINUING DATA

This application is a continuation of Ser. No. 589,137, filed Mar. 13, 1984, now abandoned.

BACKGROUND OF THE INVENTION

This invention relates to a tone waveshape generation device employed in an electronic musical instrument and, more particularly, to a device capable of reading out successive waveshapes of plural periods stored in a memory.

A device which prestores successive waveshapes of plural periods from the start to the end of tone generation in a memory and generates tone waveshape signals by reading out these prestored waveshapes is known, e.g., in the specification of U.S. Pat. No. 4,305,319. The United States patent discloses a drum generator in which snare drum sounds and other drum sounds are prestored in the form of successive waveshapes of plural periods in respectively corresponding memories and these waveshapes are read out in response to a sound timing signal (play strobe signal). This type of prior art tone waveshape generation device has heretofore been used as a tone source of rhythm sounds and increase in the memory capacity to some extent has not posed any serious problem since necessity for changing the tone pitch is not involved in this type of device.

If, however, this type of tone waveshape generation device is applied to generation of scale notes, it becomes necessary to prepare successive waveshapes of plural periods for respective different tone pitches or tone ranges with a result that the capacities of memories become extremely large. If, for example, the duration of tone generation is 5 seconds, the sampling period is 32 kHz and successive waveshapes of plural periods are prepared over 4 octaves one for each tone range which has been determined for 3 scale notes (keys) in 12 scale notes of one octave (totalling 16 tone ranges), a memory having a capacity of "32k×5×16=2560 kilo words" is required.

An electronic musical instrument of a type in which, in the above described manner, a complete waveshape from the start to the end of generation of a tone is prestored for each key (note) and then is read out is disclosed in the specification of U.S. Pat. No. 4,383,462. In the waveshape memory WM31 shown in FIG. 3 of this United States patent, a complete waveshape is stored and this complete waveshape is read out in response to a signal KD which represents a key depression timing.

An improvement has been conceived for preventing the capacity of the memory storing the complete waveshape from becoming too large. According to this improvement, the attack portion of the tone is stored in its entirety but only a part of the sustain portion is stored and the stored part of the sustain portion is repeatedly read out to generate the entire sustain portion. In the above U.S. Pat. No. 4,383,462, an example of such improvement is shown in FIG. 6. A complete waveshape in the attack period is stored in the waveshape memory WM61 and at least one fundamental period of a tone waveshape is stored in the waveshape memory WM62. An attack waveshape is read out from the memory WM61 in response to the key depression (KD signal) and the tone waveform of the fundamental period is repeatedly read out from the memory WM62 after completion of the read out of the attack waveshape (IMF signal) until the end of tone generation (DF signal). According to this improvement, the memory capacity can be reduced to, e.g. about one-fifth. If in this case the memory length of the memories corresponding to the respective tone pitches (tone ranges) is made uniform, blank area will occur in the memories. The memory length is determined by the lowest tone due to the fact that the rise time of the tone increases as the tone becomes lower and hence blank area will occur in a part of the zone of the memory storing the higher note waveshape which is shorter in the rise time resulting in the waste of the memory zone.

SUMMARY OF THE INVENTION

It is, therefore, an object of the invention to effectively utilize the memory zone of the memory without waste in a tone waveshape generation device using a memory storing successive waveshapes of plural periods.

According to the invention, in a waveshape memory, successive waveshapes of plural periods are stored in memory zones corresponding to respective tone pitches or tone ranges in memory capacities which differ from one another depending upon the tone pitch or tone range. According to information representing the tone pitch or tone range of a tone to be generated, the memory zone of the waveshape memory is designated and waveshapes of plural periods stored in the designated memory zone are read out. Since capacities of the respective memory zones of the waveshape memory are made different, the wavesahpe memory can be effectively utilized without waste.

For example, designation of the memory zone is performed by designating a start address representing the first address of that memory zone and memory length information concerning the memory capacity of that memory zone (i.e., the number of address or words of the memory zone). Alternatively, information representing the final address of the memory zone may be used instead of the memory length information.

BRIEF DESCRIPTION OF THE DRAWINGS

In the accompanying drawings

DESCRIPTION OF PREFERRED EMBODIMENTS

Figure 1:
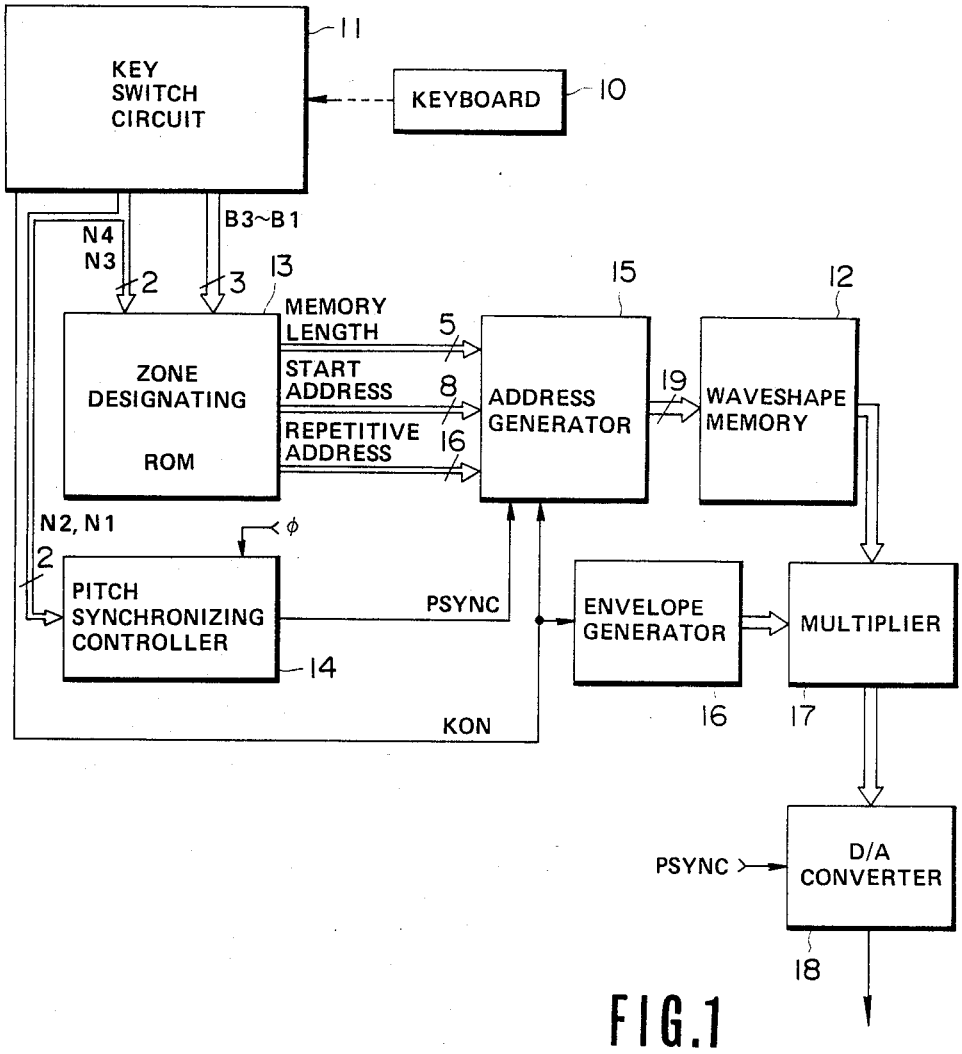
FIG. 1 is an electrical block diagram showing an embodiment of the invention applied to a monophonic electronic musical instrument.

FIG. 1 shows an embodiment of the invention applied to a monophonic electronic musical instrument. A key switch circuit 11 detects a key depressed in keyboard 10 in accordance with the predetermined order of priority and thereupon produces a key code representing the depressed key (consisting of a 3-bit octave code B3–B1 and a 4-bit note code N4–N1) and a key-on signal KON. A waveshape memory 12 stores, at memory zones corresponding to respective tone ranges, successive waveshapes of plural periods. Memory capacity of respective memory zones differs from tone range to tone range each consisting of three keys. Three keys of one tone range are keys of semitone intervals (e.g., C2, C#2 and D2). Assuming that the key range in the keyboard 10 includes C2–C7 (5 octaves plus 1 key), the number of memory zones (the number of the tone range of three keys) is 21.

Figure 2A:
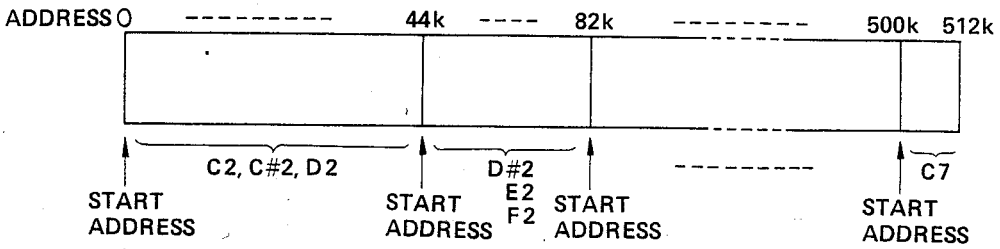
FIG. 2*a* is an example of division of the respective memory zones in a waveshape memory in FIG. 1.
Figure 2B:
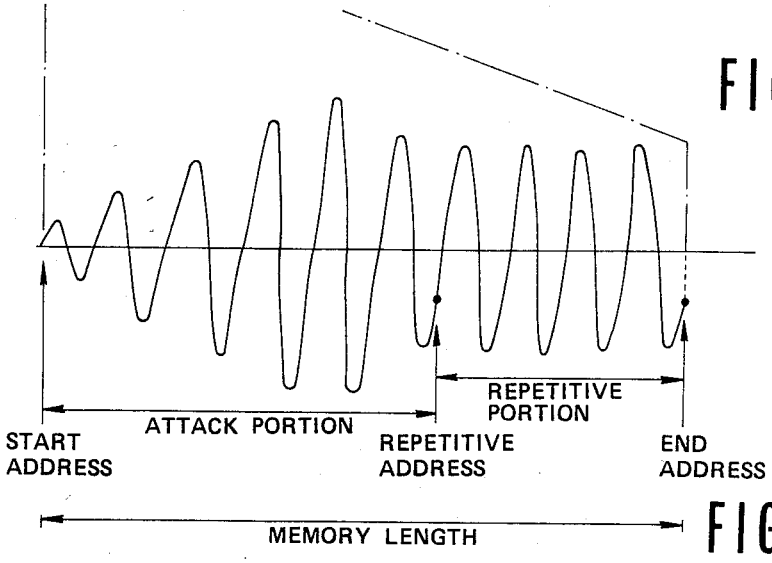
FIG. 2*b* is an example of a waveshape stored in a memory zone in a waveshape memory in FIG. 1.

In each memory zone in the waveshape memory 12, there are stored successive waveshapes of plural periods ranging from the rising portion to a part (repetitive portion) of the sustain portion of the waveshape as shown in FIG. 2*b*. The attack portion is read out only once whereas the repetitive portion is repeatedly read out whereby a full waveshape of the sustain portion is generated. A decay waveshape is generated by repeatedly reading out the sustain portion while a decay envelope is imparted to the read out waveshape.

A memory zone to be read out in the entire waveshape memory 12 can be designated by a start address representing the first address in the rise portion and memory length information representing the number of all addresses in that memory zone. The repetitive portion of that memory zone can be designated by employing a repetitive address representing the first address in the repetitive portion.

FIG. 2*a* shows an example of division of the respective memory zones in the waveform memory 12. For instance, the zone of 44 kilo words from address 0 to address 43999 stores successive waveshapes of the lowest tone range consisting of keys of C2, C#2 and D2. The zone of 38 kilo words from address 44000 to address 81999 stores successive waveshapes of a tone range consisting of keys of D#2, E2 and F2. There are start address, memory length and repetitive address peculiar to each memory zone, as was previously described with reference to FIG. 2*b*. Each memory zone stores successive waveshapes peculiar thereto.

The frequency of the successive waveshape stored in each memory zone is set such that it becomes equal to the frequency of a tone of a middle key in the tone range (e.g., C#2) in the lowest tone range when it is read out with a predetermined reference sampling clock. In a case where a tone waveshape for the lowest key (e.g., C2 in the lowest tone range) in each tone range is to be generated, the successive waveshapes are read out by using a sampling clock which is produced by lowering the rate of the reference sampling clock by 100 cents. The read out of the tone waveshape corresponding to the highest key (e.g., D2 in the lowest tone range) in each tone range is made by using a sampling clock which is produced by raising the rate of reference sampling clock by 100 cents. As a result, although tone waveshapes corresponding to three keys in the same tone range are read out from the same memory zone in the waveshape memory 12, frequencies of the read out tone wavehsapes are different from each adjacent tone waveshape by 100 cents due to the difference of the sampling clock rate by 100 cents. In the above described manner, reading is performed in a pitch synchronizing way so that the sampling clock is synchronized with the pitch of the tone to be generated and one sample point corresponds to one address.

A zone designating ROM (abbreviation of read-only memory) 13 prestores the start address, memory length information, repetitive address corresponding to each tone range consisting of three keys, receives at its address input the octave code B3–B1 and the higher 2 bits N4 and N3 of the note code provided by the key switch 11 (i.e., information representing the tone range of the tone to be generated) and provides the start address, memory size information and repetitive address in accordance with the tone range to which the depressed key belongs. Correspondence between the note code N4–N1 and the respective notes C–B in one octave is as shown in the table below in which an adjacent group of three keys can be distinguished by the higher two bits N4 and N3.

| note | note code N4 | N3 | N2 | N1 | deviation from the reference sampling rate (cents) |
|---|---|---|---|---|---|
| C | 0 | 0 | 0 | 0 | −100 |
| C# | 0 | 0 | 0 | 1 | 0 |
| D | 0 | 0 | 1 | 0 | +100 |
| D# | 0 | 1 | 0 | 0 | −100 |
| E | 0 | 1 | 0 | 1 | 0 |
| F | 0 | 1 | 1 | 0 | +100 |
| F# | 1 | 0 | 0 | 0 | −100 |
| G | 1 | 0 | 0 | 1 | 0 |
| G# | 1 | 0 | 1 | 0 | +100 |
| A | 1 | 1 | 0 | 0 | −100 |
| A# | 1 | 1 | 0 | 1 | 0 |
| B | 1 | 1 | 1 | 0 | +100 |

The less significant 2 bits N2 and N1 in the note code are supplied to a pitch synchronizing controller 14 and used therein for distinguishing which key among three keys of memory zone is depressed. The controller 14 generates a sampling clock PSYNC by utilizing a master clock pulse $\phi$. The controller 14 produces the sampling clock PSYNC at the reference rate when, as was previously described, the tone to be generated corresponds to the middle key in the group of three keys (i.e., N2 and N1 are "01"), produces the sampling clock PSYNC at a rate which is lower than the reference rate by 100 cents when the tone corresponds to the lowest key in the group (i.e., N2 and N1 are "00") and produces the sampling clock PSYNC at a rate which is higher than the reference rate by 100 cents when the tone corresponds to the highest key in the group (i.e., N2 and N1 are "10").

The address generator 15 generates address information identifing an address of the waveshape memory 12, advancing the address information in response to the sampling clock PSYNC provided by the pitch synchronizing controller 14. This address information sequentially increases with the start address given by the ROM 13 being used as an initial value until the value amounts to a final address determined in accordance with the memory length information given by the ROM 13 when the reading address returns to the repetitive address given by the ROM 13. The variation from the repetitive address to the final address thereafter is repeated. Thus, the successive waveshapes in the attack portion are readout once from the memory zones of the waveshape memory 12 and thereafter the successive waveshapes of the repetitive portion in the sustain portion are repeatedly read out.

The envelope generator 16 generates a constant level envelope when the key-on signal KON is "1" (representing that a key is being depressed) and a decay envelope signal when the key-on signal has fallen to "0" (representing release of the key). A multiplier 17 imparts the successive tone waveshape signals readout from the waveshape memory 12 with an amplitude envelope in accordance with the envelope signal generated by the envelope generator 16. In the attack and sustain portions of the tone, the tone waveshape signals readout from the waveshape memory 12 are directly provided from the multiplier 17 whereas in the decay portion, the tone waveshape signal imparted with the decay envelope in accordance with the decay envelope signal is provided from the multiplier 17. The output signals from the multiplier 17 are converted to analog signals by a digital-to-analog converter 18.

Figure 3:
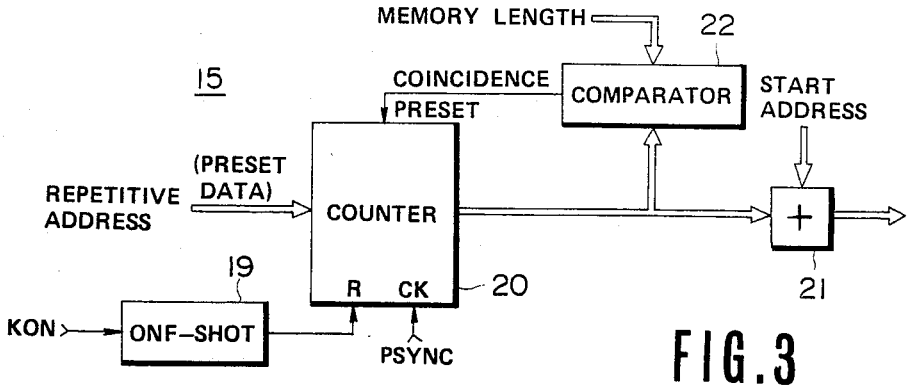
FIG. 3 is an electrical block diagram showing an example of the address generator in FIG. 1.

The address generator 15 can be constructed as shown in FIG. 3. When the key-on signal KON has risen to "1", a counter 20 is reset through a one-shot circuit 19 thereby starting counting of the sampling clock pulse PSYNC from 0. An adder 21 adds the count output of the counter 20 and start address data together and supplies its output to the waveshape memory 12 as an address information. Accordingly, the address information starts from a predetermined start address. In a comparator 22, the output of the counter 20 is compared with the memory length information and, when coincidence has occurred, the repetitive address data is preset in the counter 20. It is when the output of the counter 20 indicates the final address of the particular memory zone that the coincidence output is produced from the comparator 22 and, by presetting the repetitive address data in the counter 20, the output of the adder 21 is returned to the repetitive address. The start address data is an absolute address of the waveshape memory 12 while the repetitive address data is a relative address to the start address data.

Determination of the start address, memory length and repetitive address is advantageously made as follows. For effectively utilizing the entire memory capacity of the waveshape memory 12, the entire memory capacity of the waveshape memory 12 is first determined rather than the number of sample points of the successive waveshapes corresponding to the respective tone ranges, and this entire memory capacity is divided properly for the memory zones corresponding to the respective tone ranges. In dividing the memory capacity, more memory capacity is generally allotted to a low frequency tone range in which the rise time is long, as was previously described. Assuming, for instance, that the entire memory capacity of the waveshape memory 12 is 512 kilo words, the capacity of each memory zone should preferably be set on the basis of 2 kilo words (i.e., it will become an integer multiple of 2 kilo words). Thus, the start address of each memory zone is determined on the basis of 2 kilo words and the start address data can be expressed by 8 bits, for example "$512 \div 2 = 256 = 2^8$". In other words, it can be expressed omitting the address value of less than 2000. The memory length can also be expressed omitting the address value of less than 2000. If, for example, a maximum memory capacity in one memory zone is 44 kilo words, any memory length can be expressed by a binary number of 5 bits. By using a relatively large unit of division in dividing the memory capacity for the respective memory zones, the numbers of bits for expressing the start address and memory length can be reduced and the constructions of the ROM 13 and the address generator 15 can thereby be simplified.

For an effective utilization of one memory size, successive waveshapes are stored in the entire memory zone so that the waveshape amplitude value (or phase) of the final address will be randomly determined. For smooth continuation of the repeatedly read out successive waveshapes, the repetitive address is determined suitably so that the waveshape amplitude value (or phase) of the repetitive address will correspond to that of the final address. For this purpose, the repetitive address is set on a one word basis. As was previously described, since the repetitive address is a relative address within one memory size, if the maximum memory size is 44 kilo words, the repetitive address can be expressed by a binary number of 16 bits.

Figure 4:
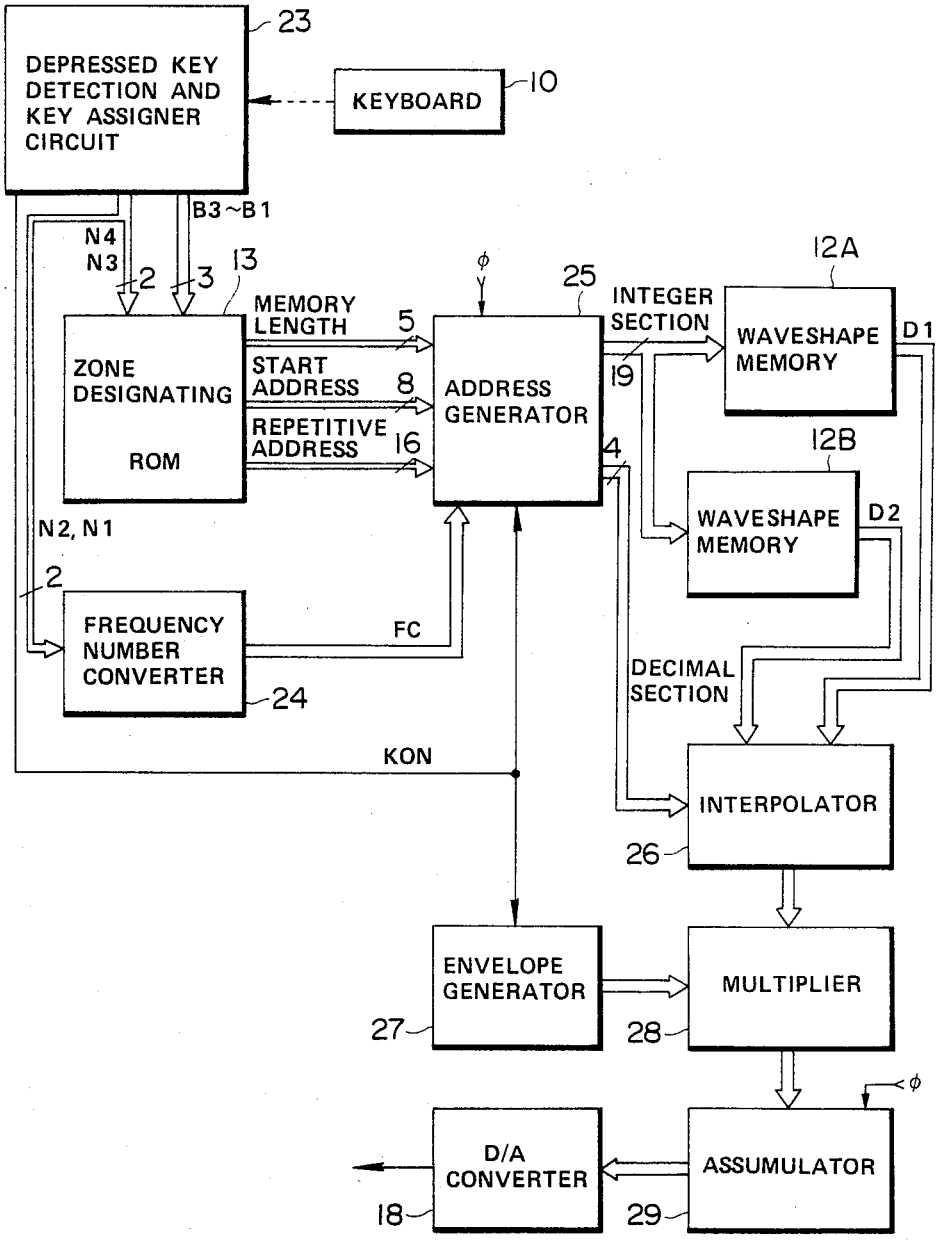
FIG. 4 is an electrical block diagram showing an embodiment of the invention applied to a polyphonic electronic musical instrument.

FIG. 4 shows an embodiment of the invention applied to a polyphonic electronic musical instrument. In this embodiment, a tone waveshape is read out on a time shared basis from plural tone generation channels. In a depressed key detection and key assigner circuit 23, depression and release of keys in the keyboard 10 are detected, a depressed key is assigned to any one of the tone generation channels, and a key code B3–B1, N4–N1 and a key-on signal KON are produced on a time shared basis. A zone designating ROM 13 is of the same construction as the one shown in FIG. 1 and provides memory length information, start address data and repetitive address data channel by channel on a time shared basis in response to an octave code B3–B1 and more significant 2 bits N4 and N3 of a note code supplied thereto on a time shared basis. A frequency number converter 24 produces a numerical value (frequency number Fc) corresponding to one of note intervals −100 cent, 0 cent and +100 cent in accordance with less significant 2 bits N2 and N1 of the note code. Alternatively stated, in this example, a tone frequency for each key in one tone range group consisting of three keys is established by changing the rate of increase of the address signal for a certain sampling timing in accordance with the frequency number Fc.

In an address generator 25, in the same manner as was previously described, the reading address of waveshape memories 12A and 12B is advanced with the start address being used as an initial value and repeatedly changed between the repetitive address and the final address. This advancing of the address is performed for each channel on a time shared basis. Timing of the change in the address, i.e., the sampling rate, is constant in correspondence to the channel time division timing. By repeatedly adding (or subtracting) the frequency number Fc at each sampling timing, the waveshape reading address for each channel advances at a rate corresponding to the frequency number Fc.

The waveshape memories 12A and 12B prestore, as in the waveshape memory 12 in FIG. 1, successive waveshapes corresponding to respective tone ranges each consisting of three keys in respective memory zones. In these memories, the memory capacity is reduced by introducing an interpolation technique to set a relatively coarse waveshape sampling interval. The waveshape memories 12A and 12B are of the same construction with each other. The memory 12A reads out a sample point which corresponds to an address designated by the address generator 25 whereas the memory 12B reads out a sample point which corresponds to an address next to the address designated by the address generator 25. Accordingly, the waveshape memories 12A and 12B produce waveshape amplitude value data D1 and D2 of sample points which are adjacent to each other. The address signal generated by the address generator 25 consists of an integer section and a decimal section and the integer section is supplied to the wavehsape memories 12A and 12B.

An interpolator 26 interpolates a waveshape amplitude value between the amplitude value data D1 and D2 of the two sample points read simultaneously out from the waveshape memories 12A and 12B with a finer sampling interval in accordance with decimal section data of the address signal provided by the address generator 25. The interpolation function for this interpolation can be set as desired. For instance, in the case of the 1st order interpolation, the interpolation is performed according to the function $$D = \frac{a(D2 - D1)}{2^N} + D1$$

where D represents interpolated output, a value of the decimal section of the address signal and N a bit number of the decimal section.

An envelope generator 27 generates, in the same manner as in the envelope generator 16 in FIG. 1, an envelope signal having a decay characteristic and, in this embodiment, generates an envelope signal for each channel on a time shared basis in response to the key-on signal KON. A multiplier 28 imparts the output tone signal of the interpolator 26 with a decay envelope in response to the output of the envelope generator 27. An accumulator 29 sums up waveshape amplitude values of the respective channels for one sample point produced by the multiplier 28 on a time shared basis. A digital-to-analog converter 18 converts the sum to an analog value.

Figure 5:
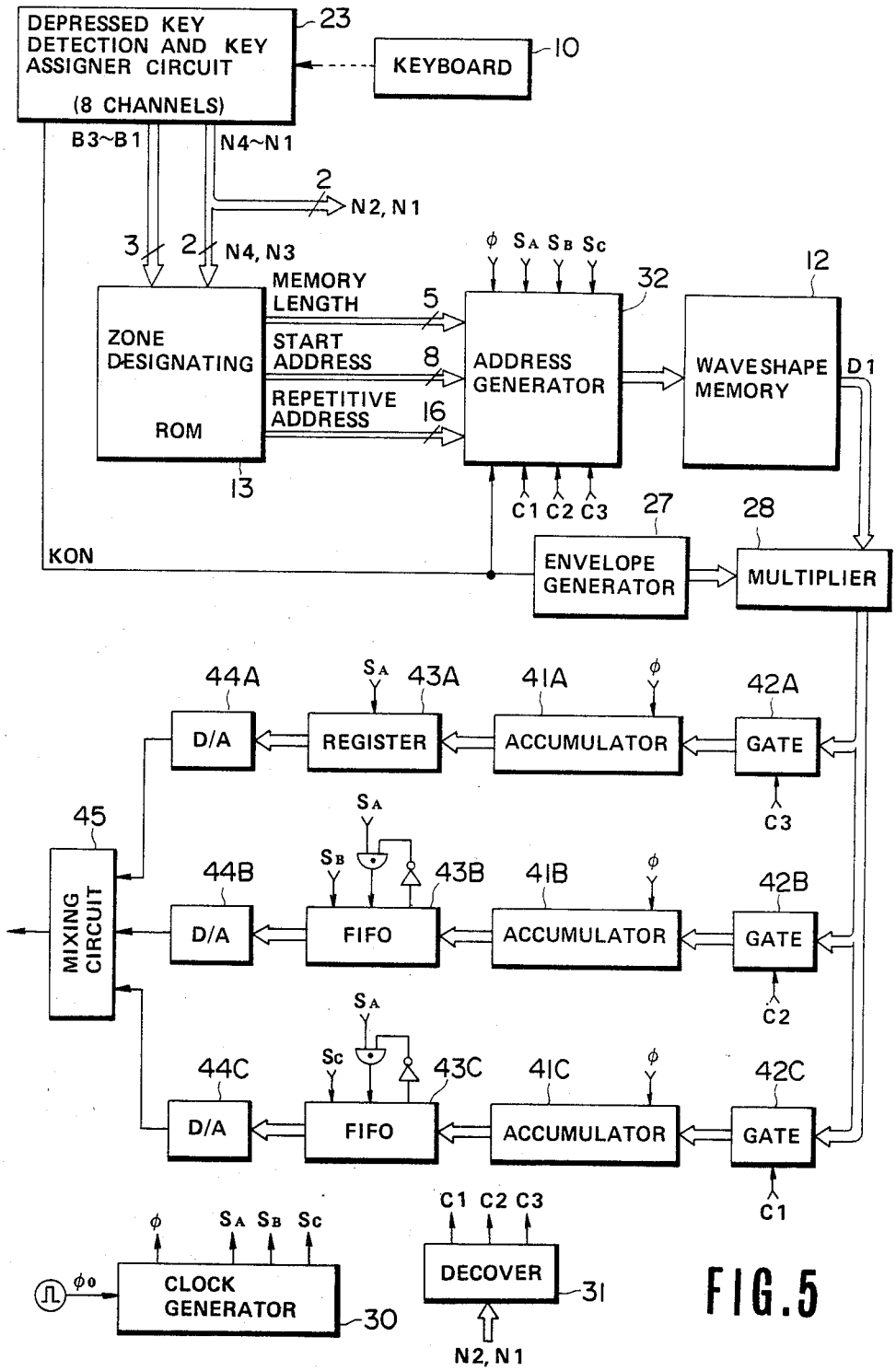
FIG. 5 is an electrical block diagram showing another embodiment of the invention applied to a polyphonic electronic musical instrument.
Figure 6:
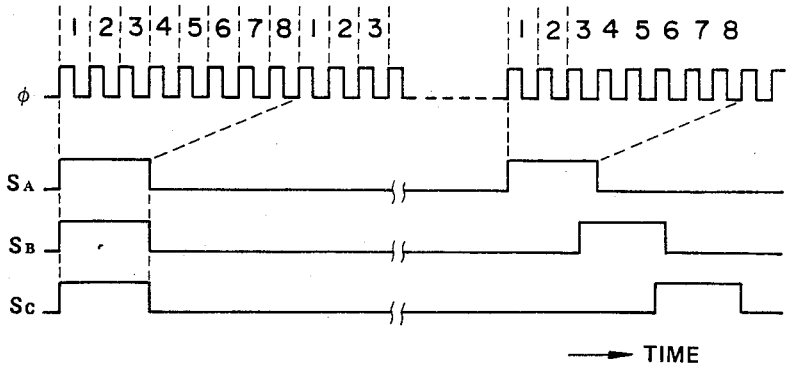
FIG. 6 is a diagram showing an example of the clock pulse used in FIG. 5.

In a case where this invention is applied to a polyphonic electronic musical instrument, address information for the read out of the waveshape may be generated by counting, in the same manner as in the embodiment of FIG. 1, the sampling clock corresponding to the relative pitch for each key in one tone range. An example of a polyphonic electronic musical instrument is shown in FIG. 5. A clock generator 30 divides the master clock $\phi_0$ (e.g. 16 MHz) in frequency to generate a clock pulse $\phi$ (e.g. 256 KHz) which establishes a channel time division time slot and three kinds of clock pulses $S_A$, $S_B$ and $S_C$ corresponding to relative pitches of respective keys in one tone range consisting of three keys. The respective clock pulses $S_A$, $S_B$ and $S_C$ have frequencies corresponding to the pitch difference of 100 cents among three keys in one tone range. The clock pulse $S_A$ corresponds to the highest tone key (e.g. 32 KHz) of the three keys, the clock pulse $S_B$ to the middle tone key which is lower than the highest tone key by 100 cents and the clock pulse $S_C$ to the lowest tone key which is lower than the highest tone key by 200 cents. The pulse widths of the clock pulses $S_A$–$S_C$ correspond to one cycle of the channel time division timing. If, for example, the number of channels is 8, the pulses $S_A$, $S_B$ and $S_C$ have a relationship as shown in FIG. 6 and the pulse generation timing of the clock pulse $S_A$ always corresponds to the width of one cycle from the first channel to the eighth channel.

A decoder 31 decodes less significant 2 bits N2 and N1 of the note code provided from the key assigner circuit 23 and produces signals C1, C2 and C3 for discriminating the respective keys in one tone range consisting of three keys. C1 is for the lowest tone key, C2 for the middle tone key and C3 for the highest tone key.

Figure 7:
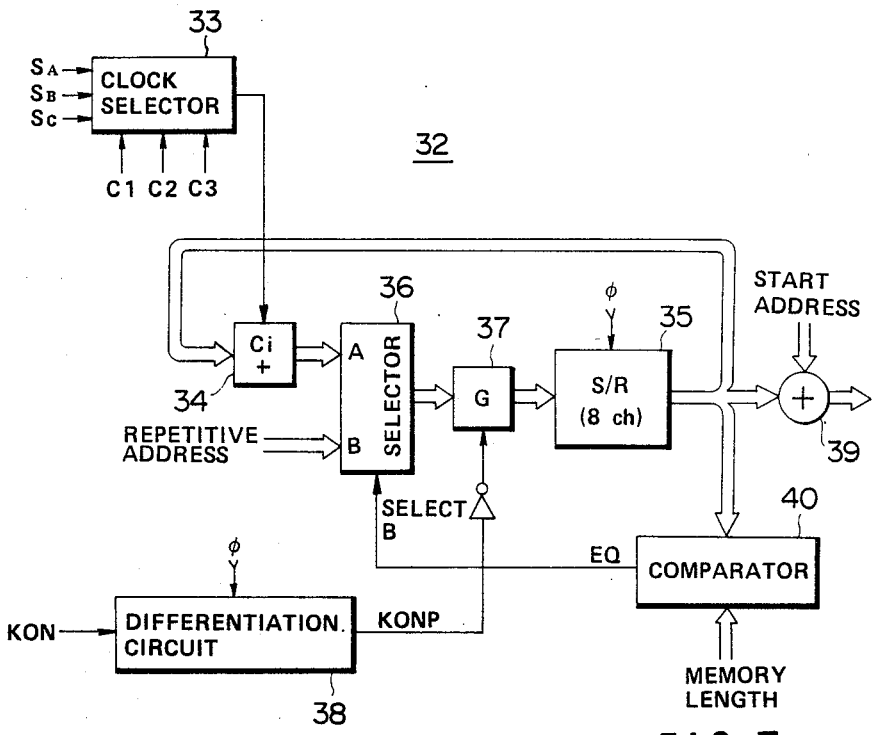
FIG. 7 is an electrical block diagram showing an example of the address generator in FIG. 5.

In the address generator 32, in the same manner as was previously described, the readout from the waveshape memory 12 is advanced with the start address being used as an initial value and the address information is repeatedly changed between the repetitive address and the final address. This advancing of the address information is performed for each channel on a time shaped basis employing the clock pulses $S_A$–$S_C$ corresponding to the relative pitches of the keys assigned to the respective channels. More specifically, one of the clock pulses $S_A$–$S_C$ is selected in accordance with the signal (one of C1–C3) representing which of the lowest, middle and highest keys in one tone range the key assigned to each channel is, and the selected clock pulse is used as the count clock for advancing the address information in the corresponding channel. Referring to FIG. 7 for a speciific example, the selection of the clock pulses $S_A$–$S_C$ is made by a clock selector in response to the signals C1–C3 and its output is supplied to an adder 34. The counter is composed of a shift register 35 having the number of stages corresponding to the number of channels (e.g. 5), the adder 34 adding the output of this shift register 35 and the output of the selector 33, a selector 36 and a gate 37. In a differentiation circuit 38, a key-on pulse KONP is produced in response to rising of the key-on signal KON of each channel provided on a time shared basis thereby to close the gate 37 and clear the count value of that channel. Thus, the counting by channel in the counters 34–37 is started from 0 and, each time "1" is provided by the clock selector 33 at the timing of that channel, the count of the channel is increased by 1. The adder 39 adds the count output of the shift register 35 and the start address data of that channel together and supplies its output to the waveshape memory 12 as the address imformation. A comparator 40 compares the count output and the memory length information of the key assigned to that channel together and, when coincidence has occurred, B input is selected by the selector 36 and the repetitive address data of the key assigned to the channel is set at the shift register 35.

In FIG. 5, accumulators 41A–41C are provided for the respective keys (three keys) in one tone range. Tone signals of the respective channels provided by the multiplier 28 are distributed in gates 42A–42C by the highest, middle and lowest tone keys by the output signals C3–C1 of the decoder 31 and the distributed tone signals are respectively accumulated by the corresponding accumulators 41A–41C. The accumulation in the accumulators 41A–41C is effected, as was described previously, only in one sample section (8 channels of first through eighth channels) and renewed each time the channel cycle is changed. A register 43A receives the accumulated output for one sample section of the accumulator 41A in synchronism with the clock pulse $S_A$ and delivers it out in synchronism with the clock pulse $S_A$. A FIFO (first-in first-out) register 43B receives the accumulated output for one sample section of the accumulator 41B in synchronism with the clock pulse $S_A$ and delivers it out in synchronism with the clock pulse $S_B$. A FIFO register 43C receives the accumulated output for one section of the accumulator 41C in synchronism with the clock pulse $S_A$ and delivers it out in synchronism with the clock pulse $S_C$. Thus, the component of the time division clock $\phi$ is removed and the tone signal composite sample point amplitude value containing components synchronized with the pitch of the tone signal (i.e., components of the clock pulses $S_A$, $S_B$ and $S_C$) is provided by the registers 43A–43C. The outputs of these registers 43A–43C are converted to analog signals by digital-to-analog converters 44A–44C and thereafter are mixed by a mixing circuit 45 and supplied to a sound system. Accordingly, by adopting the construction of FIG. 5, the influence of the time division clock $\phi$ (this clock is generally not synchronized with the tone pitch) is removed whereby a tone of a good quality can be composed even in a higher tone range.

In the above described embodiments, the waveshape memories 12, 12A and 12B store successive waveshapes of the attack portion and a part of the sustain portion in their respective memory zones. The invention however is not limited to this arrangement but these memories may store successive waveshapes of the attack portion the entire sustain portion and the decay portion with the reading of the waveshape from the start address to the final address being made only once. Alternatively, successive waveshapes of the attack portion, a part of the sustain portion and the decay portion may be stored and the waveshapes of the sustain portion may be produced by a repetitive reading.

The waveshape memories 12–12B may store successive waveshapes corresponding to the tone pitch of one key. In this case, each memory zone is read out in the same manner by the reference rate. The division of the tone range is not limited to three keys but may be made as desired, e.g., two keys, four keys, half octave etc.

What is claimed is:

1. A tone waveshape generation device comprising:

means for providing a key code information identifying a selected note a waveshape memory including memory zones having memory capacities which differ from one another depending upon respective predetermined tone pitch ranges, each of said ranges encompassing a plurality of musical notes, said memory zones each storing data of a full waveshape of an attack portion and plural periods of a subsequent repetitive portion of a musical tone waveshape;

memory zone designation means, responsive to said key code information, for designating the one of said memory zones corresponding to the tone pitch range which encompasses said selected note of a tone to be generated;

readout means, having a controllable readout rate, for once reading out from said designated memory zone said data representing said full waveshape of an attack portion and for thereafter repeatedly reading out from said designated memory zone said data representing said plural periods of a repetitive portion of a waveshape; and controller means, cooperating with said readout means, for establishing the readout rate of said waveshape data from said designated memory zone in accordance with said key code information designating the selected note within said tone range, said controller means establishing a different readout rate for each of said plural notes within the corresponding tone pitch range.

2. A tone waveshape generation device as defined in claim 1 wherein each of said memory zones in said waveshape memory has a memory capacity which increases as the tone pitch becomes lower.

3. A tone waveshape generation device as defined in claim 1 wherein said memory zone designation means performs designation of said memory zone by start address data representing the first address in the memory zone to be designated and memory length data corresponding to difference between said start address data and final address data representing the final address of data stored in the designated memory zone.

4. A tone waveshape generation device as defined in claim 3 wherein the memory capacity of the respective memory zones are determined in such a manner that the number of words of said respective memory zones is a multiple of a relatively large predetermined number and said start address data and memory length data are respectively represented by a numerical value corresponding to the quotient obtained by dividing absolute values of said data by said predetermined number.

5. A tone waveshape generation device as defined in claim 4 wherein said predetermined number is a divisor of a maximum number of words which can be stored in said waveshape memory as a whole.

6. A tone waveshape generation device as defined in claim 1 wherein said respective memory zones in said waveshape memory store a complete waveshape of a tone signal from the start to the end of tone generation and said readout means produces the tone signal by once reading out the complete waveshape.

7. A tone waveshape generation means as defined in claim 1 which further comprises means for imparting a decay envelope to a tone signal corresponding to the waveshape data of the repetitive portion read from said waveshape memory by said readout means.

8. A tone waveshape generation device as defined in claim 1 wherein said memory zone designation means performs the designation of the memory zone by start address data representing the first address of a memory zone to be designated and memory length data representing a maximum number of words which can be stored in said memory zone and also generates repetitive address data determining the point of repetition of said repetitive portion, said repetitive address data being expressed by a relative value based on said start address.

9. A tone waveshape generation device as defined in claim 1 wherein said respective memory zones in said waveshape memory store data of waveshapes of plural periods of the decay portion.

10. A tone waveshape generation device as defined in claim 1 wherein each said tone pitch range encompasses a group of plural keys within an octave.

11. A tone waveshape generation device as defined in claim 1 wherein said memory zones each stores sample values for waveshapes of at least one period and said readout means successively reads out said sample values of waveshapes of at least one period stored in the designated memory zone.

12. A tone waveshape generation device as defined in claim 11 wherein said waveshape memory consists of first and second waveshape memories having the same memory contents and said supply means has sample values of two adjacent sample points read from said first and second waveshape memories by said readout means.

13. A tone waveshape generation device as defined in claim 10 further comprising supply means for supplying sample values of two adjacent sample points simultaneously in response to the reading out by said readout means, and interpolation means for effecting interpolation between adjacent sample values of the stored waveshape to produce a tone signal.

14. An electronic musical instrument as defined in claim 13 wherein said zone designating means provides information indicating the first address of the memory zone containing the waveshape for the octave and subset portion of the designated key code, the repetitive address which represents the address within the memory zone where the repetitive portion of the waveshape is stored, and the length of the memory zone.

15. An electronic musical instrument as defined in claim 13 wherein each of said memory zones stores only one waveshape which corresponds to the middle note of a subset of three notes within an octave, and said pitch determinative readout controller means varies the rate of readout of the stored waveshape by −100 cents, 0 cents, or +100 cents based on which of said three notes was actually played.

16. An electronic musical instrument in which a musical tone is produced to correspond to a designated key code identifying a selected note and including octave and specific note subset portions, comprising:

a memory having plural zones each storing a musical tone waveshape with an attack portion and a repetitive portion, each zone being associated with a particular octave and subset of notes within that octave;

zone designating means, responsive to octave and note subset portions of the key code, for providing readout addresses for said memory corresponding to the zone of said memory containing the waveshape for the octave and subset portion for the note selected by said designated key code; and pitch determinative readout controller means, responsive to the portion of the key code designating the specific note within said subset, for controlling, in accordance with said specific note, the rate of readout of the stored waveshape from the zone of the memory having the address established by said zone designating means, the rates of readout established by said controller means being different for each of the notes of the subset associated with that zone.

* * * * *